United States Patent [19]

Pan et al.

[11] 4,027,607

[45] June 7, 1977

[54] PULSED POWDER APPLICATION SYSTEM

[75] Inventors: Peter N. Y. Pan, Country Club Hills; Rafael J. Hernandez, Chicago, both of Ill.

[73] Assignee: Continental Can Company, Inc., Chicago, Ill.

[22] Filed: Apr. 20, 1976

[21] Appl. No.: 678,676

[52] U.S. Cl. ..... 118/2; 118/654; 118/646

[51] Int. Cl.[2] ..... B05B 5/02

[58] Field of Search ..... 118/629–635, 118/DIG. 5, 2, 7, 8, 654, 646; 427/21, 27, 28, 29, 32, 33, 38–41; 101/DIG.13; 313/231; 239/3, 15; 355/3 DD

[56] References Cited

UNITED STATES PATENTS

| | | | |
|---|---|---|---|
| 2,221,338 | 11/1940 | Wintermute | 118/630 X |
| 2,889,805 | 6/1959 | Freeder | 118/627 |
| 3,212,914 | 10/1965 | Lyle et al. | 627/37 |
| 3,248,253 | 4/1966 | Barford et al. | 118/629 X |
| 3,295,440 | 1/1967 | Rarey et al. | 101/DIG. 13 |
| 3,364,053 | 1/1968 | Beike | 118/DIG. 5 |
| 3,951,099 | 4/1976 | Minckler | 118/630 X |

*Primary Examiner*—Morris Kaplan
*Attorney, Agent, or Firm*—Diller, Brown, Ramik & Wight

[57] ABSTRACT

A pulsed powder application system for electrostatically powder-coating a substrate comprises an applicator bed means, a fluidizing means, and a pulsing means. The pulsing means is actuable during a coating time to effect ionization of electrostatic powder particles so as to cause the establishment of an electric field attracting the particles to the substrate, and actuable during non-coating times to cause the establishment of a reverse electric field attracting the ionized particles away from the substrate. A feeder bed means and an associated fluidizing means are provided for holding the electrostatic powder prior to usage for coating by the applicator bed means.

38 Claims, 9 Drawing Figures

"PULSE ON"
"PULSE OFF"
30MΩ
30KV
30MΩ

PULSED POWDER APPLICATION SYSTEM

The invention relates to a pulsed powder application system used to powder coat small objects or substrates disposed in a coating position adjacent to the system.

It has been previously known, especially in the field of electrostatic printing, to apply a high voltage corona discharge to a cloud of electrostatic particles so as to accelerate the particles toward a substrate. For example, the application of such a principle is disclosed in U.S. Pat. No. 3,295,440(Rarey et al) which sets out a method and apparatus whereby a cloud of toner particles for electrostatic printing is subjected to such a corona discharge so as to become charged and to be accelerated by the resultant electrostatic field toward a stencil and through the opened portions thereof so as to contact a substrate.

It has also been known to form cloudized toner particles (that is to say, to form a suspension of toner particles in the air) and to move the cloud of toner particles past a corona discharge means. Examples of such a technique can be found in the latter-mentioned patent, as well as in U.S. Pat. No. 3,382,796 (Javorik et al).

Prior art methods, such as those mentioned above, are inhibited by certain disadvantages. For example, a significant problem is encountered when such prior art techniques are employed to successively coat a series of substrates at high rates of coating. In such cases, a substantial and undesirable amount of powder overspray is experienced during the coating cycle. This problem is primarily due to the lack of development, within the prior art, of methods and apparatus which provide for percision control of powder shut off at the end of a cycle. In addition, the problem results from lack of development, within the prior art, of methods and apparatus for precision control of powder trailing in the applicator bed at the end of a coating cycle.

Another major problem involved in the high speed powder coating of successive substrates in an assembly line fashion is the problem of non-uniform coating of the substrates due to lack of uniformity of the electric fields provided by the corona discharge means. A further related problem voltages to achieve the necessary acceleration of the coating particles.

Conventional methods apparatus generally employ an applicator bed means for holding the electrostatic powder prior, during and after the coating cycle, and a fluidizing means associated therewith for cloudizing the electrostatic particles contained in the applicator bed means. A substantial problem concerns the control of the amount of powder retained in the applicator bed means. Specifically, the amount of powder retained in the applicator bed means must be sufficiently large so as to provide for the amount of coating required, and yet it must be sufficiently small so as to be controllable in a precise manner and to require the application of high voltages of minimal magnitude. Furthermore, a related problem is also present in the prior art in that it is necessary to provide a method and arrangement which includes provision for the replenishment of powder in the applicator bed, and which also provides for precise control of the rate of replenishment. Finally, economic considerations dictate that, during each stage of the coating process, some provision be made within the method and arrangement for the "scavenging" and recovery of stray electrostatic powder.

Thus, it is an object of this invention to provide arrangement wherein powder overspray during the coating cycle, and especially at the end of the coating cycle, is strictly controlled.

Another object of the present invention is to make possible the successive coating of a series of successive substrates at a high rate of coating and in an assembly line manner.

Another object of the present invention is to provide for the precision control of powder shut off at the end of the coating cycle.

A further object of the present invention is to provide for the creation of uniform electric fields so as to achieve uniform coating of successive substrates.

A further object of the present invention is to provide arrangement which keeps to a minimum the magnitude of high voltage discharge required to achieve electrostatic coating.

A further object of the present invention is to provide arrangement wherein the quantity and level of powder retained in the applicator bed is precisely controlled and replenished at such a rate as to cause the retention, within the applicator bed, of an amount of powder which is both sufficient for providing coating and manageable to achieve high quality coating.

Another object of the present invention is to provide arrangement wherein loss of powder is kept to a minimum, and wherein means are provided for "scavenging" and recovering stray electrostatic powder.

With the above and other objects in view that will hereinafter appear, the nature of the invention will be more clearly understood by reference to the following detailed description, the appended claimed subject matter, and the accompanying drawings, of which:

Figure 1:
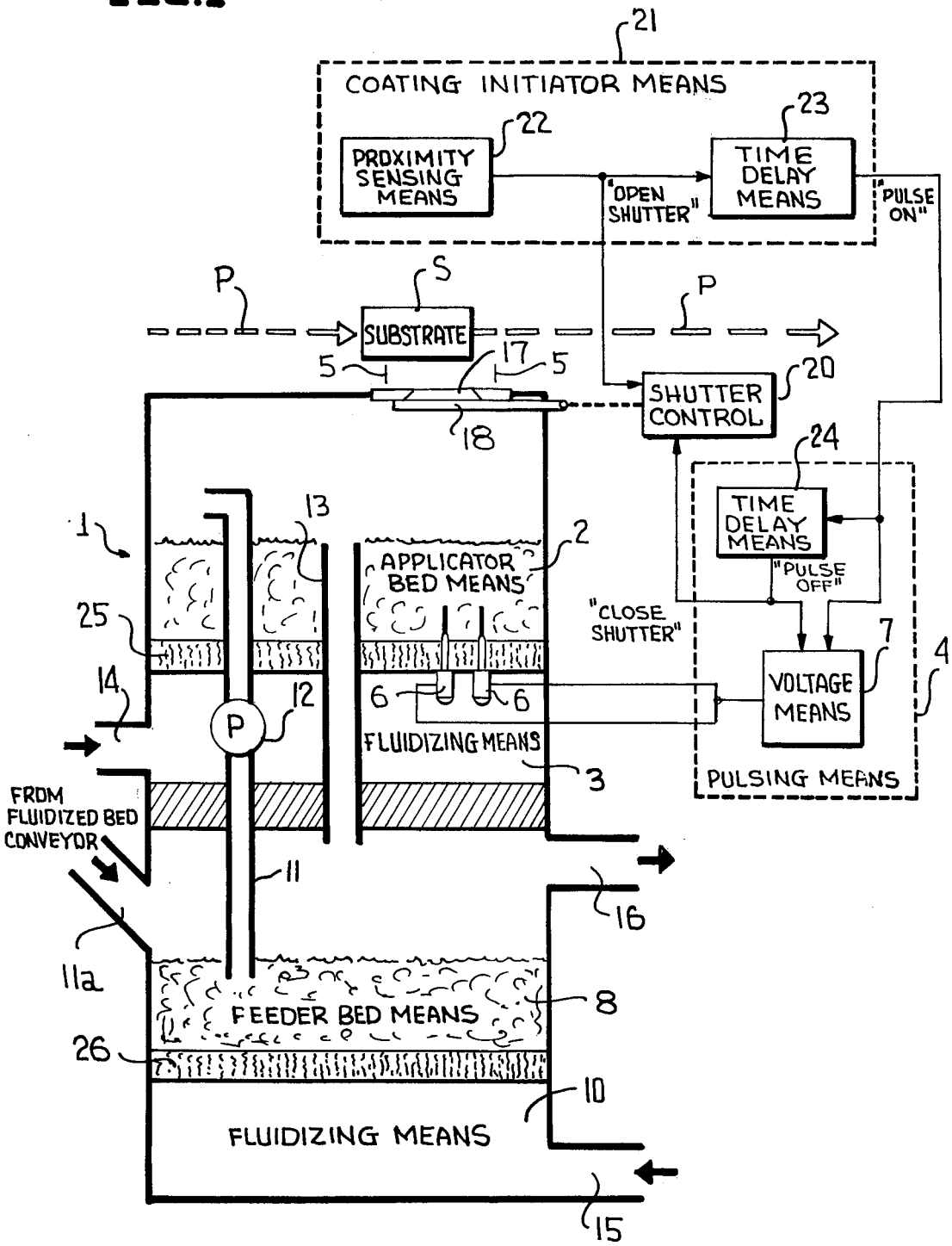
FIG. 1 is a diagrammatic representation of the pulsed powder application system according to the invention.

As mentioned above, FIG. 1 is a diagrammatic representation of the pulsed powder application system according to the present invention. Such a system includes a pulsed powder application apparatus 1 for coating a substrate S of a series of substrates moving along a path indicated by the arrows P, said movement being effected, for example, by a conveyor belt (not shown).

The pulsed powder application apparatus 1 includes an applicator bed means 2 for holding the electrostatic powder particles to be employed in electrostatic coating, and a fluidizing means 3 associated therewith for acting upon the electrostatic powder to endow it with fluid-like characteristics. The system according to the invention further includes a pulsing means 4 connected to the applicator bed means 2 for applying high voltage pulses to the fluidized electrostatic powder within the applicator bed means 2 so as to cause ionization of the powder. The ionization of the powder, in turn, causes the establishment of an electric field attracting the electrostatic powder particles toward the substrate S positioned in a coating position, generally indicated by the reference numerals 5.

As further shown in FIG. 1, the applicator bed means 2 may be equipped with a pair of electrodes 6 which are connected to the pulsing means 4. Specifically, the pair of electrodes 6 are connected to a voltage means 7 (within the pulsing means 4). The connection is made in such a manner that the pulsing means 4 has a first state for applying to both electrodes 6 a high voltage pulse which is maintained for a predetermined period of time, that is to say, the coating time, so as to effect the aforementioned ionization of the electrostatic powder within the applicator bed means 2. In addition, the pulsing means 4 has a second state for causing the establishment of an electric field opposite in direction to that electric field created by the ionization of the powder particles during the first state. Specifically, since the electrostatic powder particles become ionized during the first state, the electric field created during the second state acts on the charged particles so as to attract the particles away from the substrate S.

According to the invention, the pulsed powder application apparatus 1 may be further provided with a feeder bed means 8 for holding a relatively large supply of electrostatic powder prior to or subsequent to use for coating within the applicator bed 2. In addition, there is provided a fluidizing means 10 associated with the feeder bed means 8 for fluidizing the electrostatic powder contained within the latter. In this regard, there is also provided a conduit 11 and an associated pump 12 for transferring electrostatic powder from the feeder bed means 8 to the applicator bed means 2. It is to be understood that the pump 12 may be adjustable to provide powder to the applicator bed means 2 at a rate which is slightly in excess of the use rate of electrostatic powder due to the coating process The apparatus 1 may also be provided with a level control means or drain tube 13 which acts to drain off all excess powder above a predetermined level within the applicator bed means 2, returning the excess powder to the feeder bed means 8. In this regard, it is to be noted that the level control means 13 may be adjustable so as to establish any desired predetermined level of powder within the applicator bed means 2.

Electrostatic powder to be used in coating may be conveyed to the apparatus 1 via a fluidized bed conveyor (not shown), as is known per se, and the powder may be supplied to the feeder bed means 8 through a chute 11*a*. Furthermore, where a blower (for example, as disclosed in U.S. Pat. No. 3,382,796 to Javorik et al), air intake passages 14 and 15, as well as air exhaust passage 16, may be provided. In this regard, it is to be noted that air entering the fluidizing means 3 through the passage 14 may be expelled from the apparatus 1 via the drain tube 13 and the exhaust passage 16.

As further shown in FIG. 1, the apparatus 1 is provided with a mask 17 so as to cause the substrate S to be electrostatically coated during the coating time in selected areas only. In addition, the apparatus 1 is provided with a shutter means or a mechanical shutter 18 connected to a shutter control 20. The shutter control 20 controls the shutter 18 in such a manner as to allow coating of the substrate S during a predetermined coating time as generally indicated by the application of the high voltage pulse to the pair of electrodes 6 by the pulsing means 4, and so as to inhibit coating of the substrate S by the electrostatic powder during times other than such predetermined coating times. Whereas FIG. 1 shows a mechanical shutter 18 connected to a shutter control 20, it is to be noted that other arrangements for allowing and inhibiting the coating of the substrate S during coating and non-coating times, respectively, can be employed, as will be clear from subsequent discussion relative to FIGS. 2, 3 and 4.

The system according to the invention further includes a coating initiator means 21 connected to the shutter control 20 for causing the latter to open the shutter 18 when the substrate S arrives at the coating position 5. More specifically, the coating initiator means 21 includes a proximity sensing means 22 which, by conventional methods, detects the arrival of the substrate S at the coating position 5. For example, the proximity sensing means 22 may include a photosensor or photocell. When the arrival of the substrate S at the coating position 5 is detected, the proximity sensing means issues an "open shutter" signal to the shutter control 20, and subsequent movement of the shutter 18 is effected.

The coating initiator means 21 further includes a time delay means 23 connected to the proximity sensing means 22 so as to receive the open shutter signal therefrom. After a predetermined time delay, the time delay means 23 generates a pulse-on signalwhich is transmitted to the pulsing means 4.

The pulsing means 4 includes, as previously mentioned, a voltage means 7 connected to the pair of electrodes 6 within the applicator bed means 2. The voltage means 7 is connected to receive the pulse-on signal from the coating initiator means 21, whereupon the desired high voltage pulses are applied to the pair of electrodes 6. The pulsing means 4 further includes a time delay means 24 to which is also transmitted the pulse-on signal from the coating initiator means 21. After a given time delay, the time delay means 24 transmits a pulse-off signal to the voltage means 7 and a simultaneous "close shutter" signal to the shutter control 20. Thus, the voltage means 7 removes the high voltage pulse from the pair of electrodes 6 and establishes a reverse electric field in a manner to be described. In addition, the shutter control 20 effects the movement of the shutter 18 to the "closed" position.

As further shown in FIG. 1, a plate 25 is positioned in horizontally level orientation between the applicator bed means 2 and the fluidizing means 3 for the purpose of maintaining the powder in the applicator bed means 2 uniform in depth. In addition, a plate 26 may be provided between the feeder bed means 8 and the fluidizing means 10 for the same purpose. Moreover, in the case where the fluidizing means 3 and 10 are of such a nature as to apply forced air to the powder within the applicator bed means 2 and the feeder bed means 8, respectively, it is to be noted that the plates 25 and 26 may be provided with perforations (not shown) to allow fluidization of the powder within the two bed means 2 and 8.

It is to be further noted that the dimensions of the applicator bed means 2 relative to the dimensions of the feeder bed means 8, as shown in FIG. 1, are not intended to be to scale. Moreover, it is preferable that the dimensions of the applicator bed means 2 be small relative to the dimensions of the feeder bed means 8 as to minimize the required magnitude of high voltage discharge necessary to be applied by the voltage means 7 in order to achieve the desired ionization of the fluidized powder within the applicator bed means 2.

Finally, as shown in FIG. 1, the plate 25 may serve the additional function of providing a mounting for the pair of electrodes 6 so as to allow the electrodes 6 to extend into the fluidized powder contained within the applicator bed means 2.

A more detailed description of the pulsed powder application apparatus 1 and of the sequential operation thereof shall now be set forth with respect to FIGS. 2, 3, 4 and 5 which are various views of a specific embodiment of a pulsed powder application apparatus according to the invention.

Figures 2, 9:
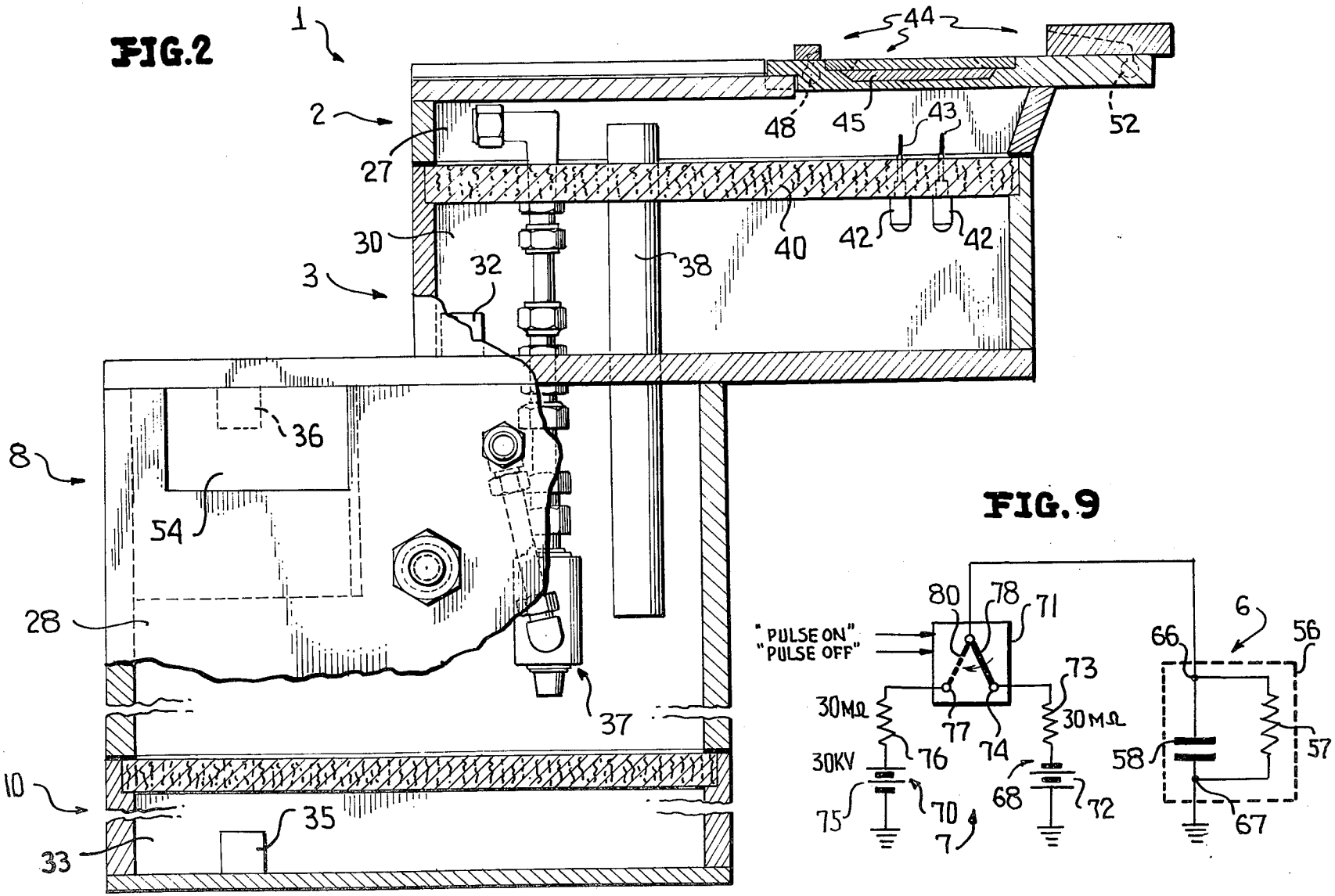
FIG. 2 is a cross-sectional view of a pulsed powder application apparatus according to the invention.
FIG. 9 is a diagrammatic representation of an alternate embodiment of the voltage switch and dump circuit of the invention.

As previously described, the pulsed powder application apparatus 1 includes an applicator bed means 2, fluidizing means 3, feeder bed means 8, and fluidizing means 10. With reference to FIG. 2, the applicator bed means 2 further comprises an upper coating chamber 27, while the feeder bed means 8 comprises a lower feed chamber 28. As can best be seen in FIG. 3, the fluidizing means 3 comprises an upper air chamber 30 and a compressor 31 connected thereto via an intake passage 32. In a similar manner, the fluidizing means 10 comprises a lower air chamber 33 and a compressor 34 connected thereto via an intake passage 35. As also shown in FIG. 3, the lower feed chamber 28 is equipped with an air exhaust passage 36.

Figure 3:
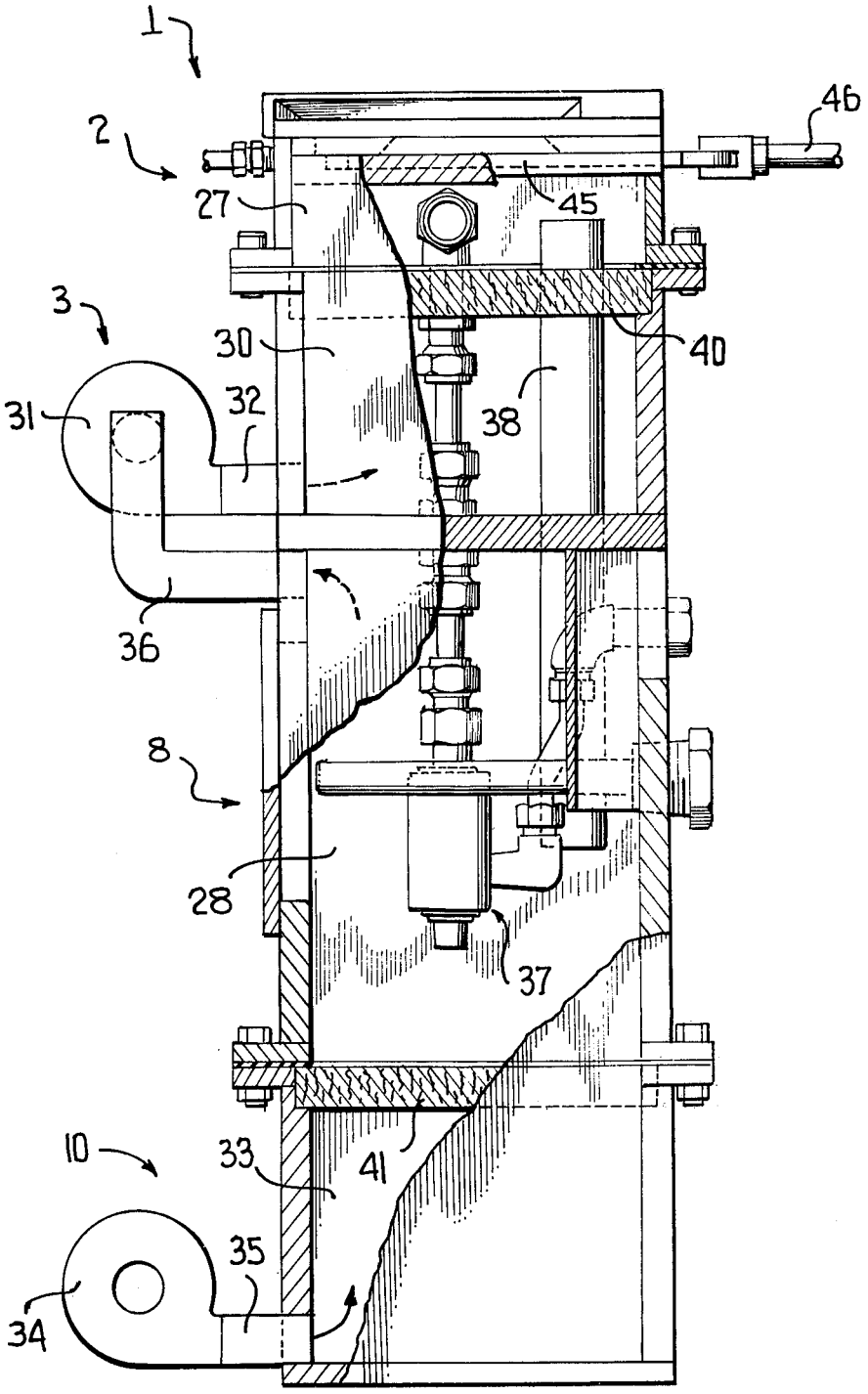
FIG. 3 is a cross-sectional side view of the pulsed powder application apparatus.

Furthermore, with reference to FIGS. 2 and 3, a pump 37 (which may be of the venturi type or other type) is provided and extends from the lower feed chamber 28 to the upper coating chamber 27. The drain level controller 38 also extends from the upper coating chamber 27 to the lower feed chamber 28. A porous plate 40 is provided in horizontally level orientation between the upper coating chamber 27 and the upper air chamber 30, while a porous plate 41 is provided in horizontally level orientation between the lower feed chamber 28 and the lower air chamber 33. Finally, as best shown in FIG. 2, the plate 40 acts as a mounting for a pair of electrodes 42, each of the electrodes 42 having a corona pin 43 extending into the upper coating chamber 27.

Additionally, the apparatus 1 is provided (as best shown in FIG. 2) with a shutter means 44, two alternative embodiments of the shutter means 44 being shown. The shutter means 44 may comprise a mechanical shutter 45 which (as shown in FIG. 3) is controlled by a shutter control (not shown) acting through the control arm 46. Alternatively, as can best be seen in FIGS. 4 and 5, the shutter means 44 may comprise an air duct 47 connected to an air compressor and shutter control (both not shown) via an air intake 48, the latter combination functioning to direct a curtain of air in the direction indicated by the arrows 50 to an air manifold 51 connected to an air exhaust 52.

Figures 4, 5, 6, 7, 8:
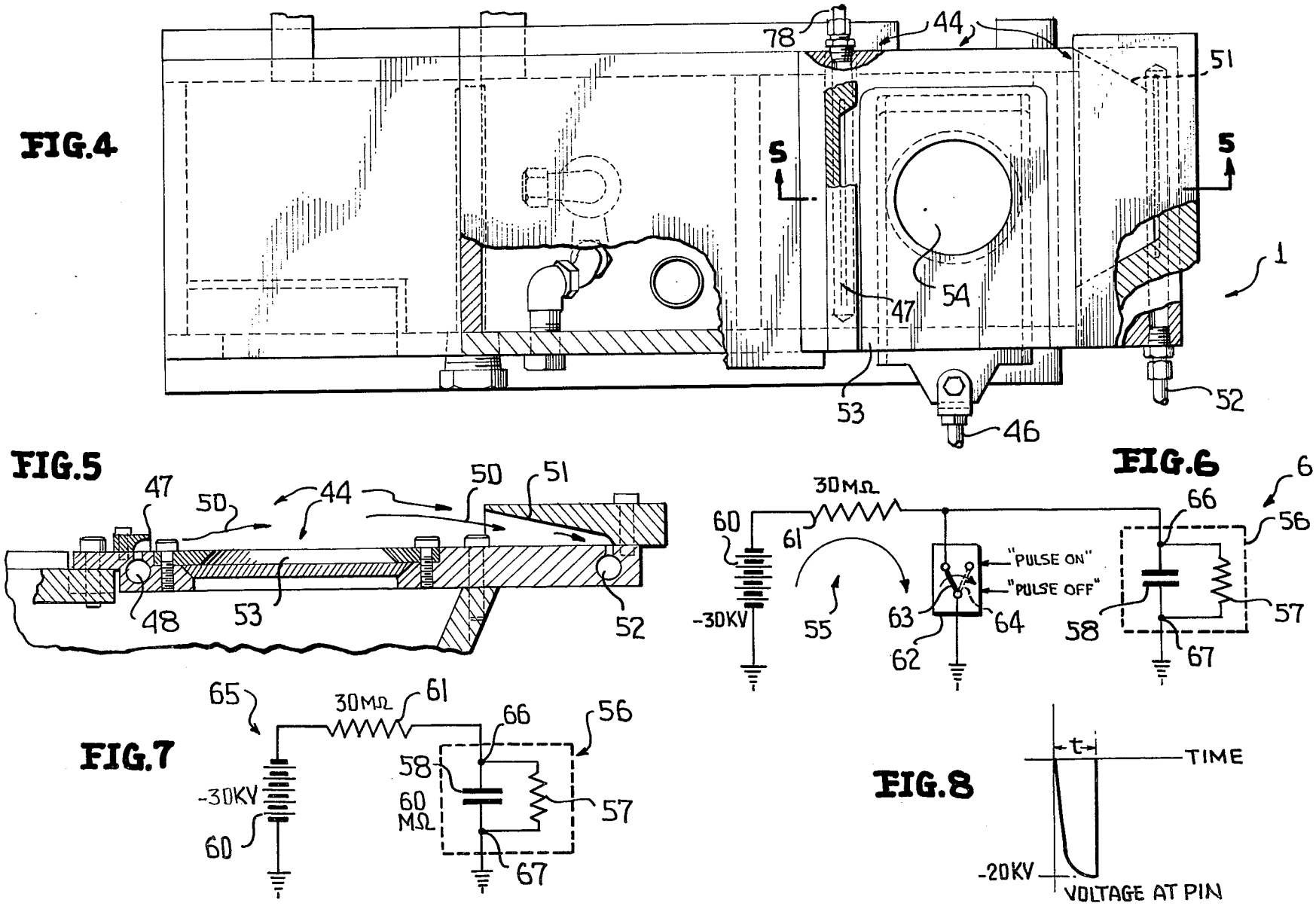
FIG. 4 is a top view of the pulsed powder application apparatus.
FIG. 5 is a cross-sectional view along the section line 5—5 of a portion of the pulsed powder application apparatus
FIG. 6 is a diagrammatic representation of the voltage switch and dump circuit of the invention.
FIG. 7 is a diagrammatic representation of the effective circuit formed by the voltage switch and dump in the "pulse off" mode of operation.
FIG. 8 is a graphical representation of the high voltage applied by the voltage switch and dump during the pulse on or coating time.

Finally, as can best be seen in FIGS. 4 and 5, the apparatus 1 is equipped with a mask 53 positioned adjacent the shutter means 44. The mask 53 is configured in such a manner (for example, as indicated by the opening 54) as to allow coating of the substrate S (see FIG. 1) in selected areas only.

The most important aspects of the invention and the specific embodiment thereto having been described above, further aspects of the invention will become quite clear from the following description of the sequential operation of the invention. With reference to FIGS. 1 and 2, electrostatic powder (not shown) is fed via a fluidized bed conveyor 11a through the port 54 into the lower feed chamber 28. With reference to FIGS. 2 and 3, air or other gas enters the lower air chamber 33 via the passage 35 at a controlled pressure and flow such that it is forced through the porous plate 41 into the lower feed chamber 28, thus fluidizing the incoming electrostatic powder. As is known, once fluidized, the fluidized powder mass has properties similar to a liquid in that it can be poured, pumped or drained.

A venturi-type pump 37 (or other pumping means) is used to transport the fluidized powder from the lower feed bed 28 into the upper coating chamber 27. Air or other gas enters the upper air chamber 30 via the passage 32 and is forced through the porous plate 40 into the upper coating chamber 27. This air fluidizes the powder supplied to the upper coating chamber 27.

It is noted that the porous plate 40 is positioned in horizontally level orientation. Due to the liquid properties of the fluidized powder, the horizontally level orientation of the porous plate 40 causes the depth of the powder throughout the upper coating chamber 27 to be uniform. In addition, when the level of the fluidized powder within the upper coating chamber 27 rises above a preset height, the drain pipe level controller 38 will act to drain the powder "overflow" back into the lower feed chamber 28. It is to be further noted that the pump 37 is adjusted to pump at a rate just above the powder use-rate during coating. Thus, by raising or lowering the drain pipe level controller 38, the fluidized powder level can be controlled to a high degree of precision.

The coating operation itself can best be understood by reference to FIGS. 6, 7 and 8. As previously described with respect to FIG. 1, the invention includes a pulsing means 4 for providing a high voltage pulse during a predetermined coating time. Additionally, the voltage means 7 within the pulsing means 4 acts, during the non-coating time, to establish a reverse electric field. Thus, according to one embodiment shown in FIG. 6, the voltage means 7 (FIG. 1) comprises a D.C. circuit, generally indicated as 55, connected to the pair of electrodes 6 (FIG. 1) so as to form a closed electrical loop therewith. As is known, the pair of electrodes 6 (FIG. 1) may be represented by the effective circuit 56 comprising the resistor 57 and the capacitor 58.

One embodiment of the circuit 55 is shown in FIG. 6, and comprises a D.C. source 60 connected in series with a resistor 61, the source 60 having one terminal connected to electrical ground. The circuit 55 further includes a relay 62 (for example, a Jennings relay) connected to electrical ground. The relay 62 has a first position 63 for connecting the series combination of the source 60 and the resistor 61 into a closed circuit, thus effectively short-circuiting the circuit 56. The relay 62 also has a second position 64, or "open circuit" condition, for connecting the series combination of the source 60 and the resistor 61 in series with the circuit 56 so as to form a closed circuit 65 (see FIG. 7) therewith.

With reference to FIGS. 1 and 6, it is to be noted that the relay 62 is connected to receive the "pulse-on"signal from the coating initiator means 21 with the result that the relay 62 is moved from its first position 63 to its second position 64, thus establishing the circuit 65 of FIG. 7. As a result, a high voltage pulse, as is illustrated by the graph of FIG. 8, is applied to the pair of electrodes 6 for a predetermined time period t corresponding to the coating time. It is to be further noted that the relay 62 is connected to receive the "pulse-off"signal from the time delay means 24 and is responsive thereto so as to return to its first position 63. As previously mentioned, the circuit 56 is thereby effectively short-circuited. However, it is to be further noted that, since the relay 62 and the circuit 56 each have one terminal connected to electrical ground, movement of the relay 62 to the position 63 causes both terminals 66 and 67 (which correspond to the pair of electrodes 6 of FIG. 1) to be connected to electrical ground. The advantage of this will become clear in a subsequent paragraph.

An alternate embodiment of the voltage means 7 (FIG. 1) is shown in FIG. 9. The voltage means 7 comprises two D.C. circuits 68, 70, each connected through a two-way switch 71 to the pair of electrodes 6 so as to form alternate closed electrical loops therewith. As was previously described with respect to FIG. 6, a pair of electrodes 6 may be represented by the effective circuit 56 comprising the resistor 57 and the capacitor 58.

The circuit 68 comprises a D.C. source 72 connected in series with resistor 73, the source 72 having one terminal connected to electrical ground. Circuit 68 is further connected to a terminal 74 of the switch 71.

The circuit 70 comprises a D.C. source 75 connected in series with a resistor 76, the source 75 having one terminal connected to electrical ground. The circuit 70 is further connected to a terminal 77 of the switch 71.

The switch 71 has a position 78 for connecting circuit 68 in series with the circuit 56 so as to form a closed circuit therewith. Switch 71 has an additional position 80 for connecting the circuit 70 with the circuit 56 so as to form alternate an closed circuit therewith.

With reference to FIGS. 1 and 9, it is to be noted that the switch 71 is connected to receive the pulse-on signal from the coating initiator means 21 with the result the switch 71 is moved to position 78. Since the polarity of the source 72 is the same as the polarity of the source 60 (FIG. 7), movement of the switch 71 toposition 78 causes the establishment of a high voltage pulse as illustrated by the graph of FIG. 8, which pulse is applied to the pair of electrodes 6 for a predetermined time period *t* corresponding to the coating time. It is to be further noted that the switch 71 is connected to receive the pulse-off signal from the time delay means 24 and is responsive thereto so as to move to position 80. Since the polarity of source 75 is opposite to that of source 72, movement of the switch 71 to position 80 causes the establishment of a high voltage pulse similar, but opposite in polarity, to the high voltage pulse illustrated in FIG. 8. Such a pulse is applied to the pair of electrodes 6 during the noncoating time, and the advantage of this will become clear in a subsequent paragraph.

Having thus described the invention, the sequential operation of the invention during coating is as follows: With reference to FIG. 1, the substrate S to be coated moves along a path indicated by the arrows P so as to arrive at a coating position 5. When the substrate S arrives at the coating position 5, the proximity sensing means 22 within the coating initiator means 21 issues an open shutter signal to the shutter control 20 and the time delay means 23. The shutter control 20 acts immediately to open the shutter 18. As previously mentioned, the diagrammatic shutter 18 of FIG. 1 can be either the mechanical shutter 45 of FIG. 3 or the air curtain created by the combination of the air duct 47 and the air manifold 51 of FIG. 5.

Upon receipt of the open shutter signal, the time delay means 23 issues a pulse-on signal to the pulsing means 4 after a predetermined period of delay (corresponding to the time period required for the functioning of the shutter control 20). The pulse-on signal is received by the time delay means 24 and the voltage means 7 of the pulsing means 4. The voltage means 7 acts immediately to apply high voltage pulse to the pair of electrodes 6. In accordance with the embodiment of FIG. 6, this corresponds to the movement of the relay 62 to the position 64. While, in the embodiment of FIG. 9, it corresponds to movement of the switch 71 to position 78.

Upon application of the high voltage pulse to the pair of electrodes 6 the powder contained within the applicator bed means 2 becomes charged, and an electric field is created between the cloudized powder and the substrate S to be coated. With reference to FIG. 4, the charged electrostatic powder is accelerated toward the substrate S (FIG. 1) so as to coat the latter in the selected areas indicated by the opening 54 in the mask 53.

With reference to FIG. 1, the pulse-on signal received by the time delay means 24 causes the latter to issue, after a predetermined period of delay corresponding to the desired coating time, a pulse-off signal. The voltage means 7 receives the pulse-off signal and is responsive thereto so as to remove the high voltage pulse from the pair of electrodes 6. In addition, the time delay means 24 issues a closed shutter signal simultaneously with the transmission of the pulse-off signal, the closed shutter signal being transmitted to the shutter control 20. The shutter control 20 is responsive thereto so as to move the shutter 18 to the closed position. Again, the diagrammatic shutter 18 of FIG. 1 could be either a mechanical shutter 45 as shown in FIG. 3, or an air curtain created by the air duct 47 and the air manifold 51 of FIG. 5.

As previously mentioned, the voltage means 7 may also respond to the pulse off signal by connecting both electrodes 6 to electrical ground. In the specific embodiment of FIG. 6, this would correspond to movement of the relay 62 to the position 63. The connection of both electrodes 6 to electrical ground will cause an electric field to be created between the charged cloudized electrostatic powder (not shown) and the electrodes 6, the electric field being opposite in orientation to the electric field originally created in response to the pulse-on signal. Thus, the cloud of electrostatic powder will be attracted away from the substrate S (that is to say, it will be collapsed) and back toward the applicator bed means 2. Such an arrangement will have at least two advantagous results. First, the tendency of the system to experience powder overspray during the end of a coating cycle will be substantially reduced since any powder not adhering to the substrate S will be attracted back to the applicator bed means 2. Second, where high speed operation (approximately 300–400 coating cycles per minute) is desired, a relatively slow shutter 18 can be left opened and the grounding of the electrodes 6, with the associated electric field of reverse polarity, can be relied upon to attract the charge powder back to the applicator bed means 2 with resultant preclusion of any further coating of the substrate S.

As previously described with respect to FIG. 9, the voltage means 7 may also respond to the pulse-off signal by applying a reverse-polarity high voltage pulse (pulse of FIG. 8 but with opposite polarity) to the pair of electrodes 6. In the specific embodiment of FIG. 9, this would correspond to movement of the switch 71 to the position 80. The application of a reverse-polarity high voltage pulse to the electrodes 6 will cause an electric field to be created between the charged cloudized electrostatic powder (not shown) and the electrodes 6, the electric field being opposite in orientation to the electric field originally created in response to the pulse-on signal. In addition, the electric field so created will be of even greater magnitude than the electric field created by the grounding of the electrodes 6 as a result of use of a voltage means 7 as embodied in FIG. 6. Thus, as a result of the arrangement of FIG. 9, the tendency of the system to experience powder overspray during the end of a coating cycle will be even more substantially reduced, and use of the system in high-speed operation can be even further improved.

It is to be additionally noted that the air exhaust passage 16 of FIG. 1 (or the corresponding air exhaust passage 36 of FIG. 3) could be employed to carry stray electrostatic powder (that is to say, electrostatic powder which has strayed from the fluidized clouds contained within the applicator bed means 2 or the feeder bed means 8) back to the source (not shown) of electrostatic powder at the remote end of the fluidized bed conveyor 11. In the case of stray electrostatic powder contained within the applicator bed means 2, such powder will be carried, by air flow from the porous plate 25, down the drain tube 13 into the feeder bed means 8, and then out the air exhaust passage 16.

It is to be additionally noted that the apparatus of the invention can be employed for the electrostatic coating of such substrates as, but not restricted to, can end units.

Finally, while preferred forms and arrangements have been shown in illustrating the invention, it is to be clearly understood that various changes in detail and arrangment may be made without departing from the spirit and scope of this disclosure.

We claim:

1. An aparatus for electrostatically powder-coating a substrate occupying a coating position adjacent thereto, comprising in combination:

applicator bed means positioned in the vicinity of said coating position for holding electrostatic powder particles, and carrying a pair of electrodes;

fluidizing means adjacent to and operatively associated with said applicator bed means for acting on said electrostatic powder to endow it with fluid-like characteristics; and pulsing means connected to said pair of electrodes and having a first state for applying a high voltage pulse to said electrodes for a predetermined coating time so as to effect ionization of said electrostatic powder particles whereby to cause the establishment of an electric field attracting said electrostatic powder particles to said substrate, and having a second state for removing said high voltage pulse from said pair of electrodes whereby to cause the establishment of a reverse electric field attracting said ionized electrostatic powder particles away from said substrate.

2. Apparatus of claim 1 including a feeder bed means for holding said electrostatic powder when not in use for coating, additional fluidizing means adjacent to and operatively associated with said feeder bed means for acting on said electrostatic powder in said feeder bed means to fluidize it, and pump means extending between said feeder bed means and said applicator bed means for providing said fluidized powder to said applicator bed means.

3. Apparatus of claim 2 including level control means operatively associated with said applicator bed means and said feeder bed means for controlling the level of said electrostatic powder in said applicator bed means by draining off the excess powder over a predetermined level, said excess powder being returned to said feeder bed means.

4. Apparatus of claim 1 including mask means carried by said applicator bed means and positioned between said applicator bed means and said substrate for causing said substrate to be electrostatically coated in selected areas only.

5. Apparatus of claim 1 including shutter means carried by said applicator bed means and having a first condition for allowing coating of said substrate by said electrostatic powder and having a second condition for inhibiting coating of said substrate by said electrostatic powder.

6. Apparatus of claim 5 wherein said shutter means is a mechanical shutter positioned between said applicator bed means and said substrate.

7. Apparatus of claim 5 wherein said shutter means comprises air manifold means for creating an air curtain between said applicator bed means and said substrate so as to inhibit coating of said substrate whereby to establish said second condition.

8. Apparatus of claim 5 including shutter control means connected to said shutter means for moving the latter alternatively to said first and second conditions, and proximity sensing means positioned adjacent to said coating position for sensing when said substrate is in said coating position, and operatively associated with said shutter control means for causing said shutter control means to move said shutter means to said first condition.

9. Apparatus of claim 8 wherein said proximity sensing means provides an open-shutter signal when said substrate is in said coating position, and including time delay means connected to said proximity sensing means for receiving said open-shutter signal, and responsive thereto for transmitting to said pulsing means, after a predetermined period of delay, a pulse-on signal, said pulsing means being responsive thereto to apply said high voltage pulse to said pair of electrodes.

10. Apparatus of claim 1 wherein said fluidizing means includes a porous plate means positioned in horizontally level orientation for supporting and maintaining the powder in said applicator bed means.

11. Apparatus of claim 10 wherein said plate means includes means for mounting said pair of electrodes.

12. Apparatus of claim 1 wherein said applicator bed means has small dimensions so as to minimize the required magnitude of said electric field whereby to minimize the magnitude of said voltage pulse applied by said pulsing means.

13. Apparatus of claim 1 wherein said fluidizing means includes an air chamber located adjacent to said applicator bed means and remote from said substrate, air compressor means connected to said air chamber for providing a pressurized air flow into said chamber, and porous plate means disposed between said air chamber and said applicator bed means for conveying said pressurized air flow to said applicator bed means whereby to fluidize said electrostatic powder contained therein.

14. Apparatus of claim 2 wherein said additional fluidizing means includes an air chamber located adjacent to said feeder bed means and remote from said substrate, air compressor means connected to said air chamber for providing a pressurized air flow into said chamber, and porous plate means disposed between said air chamber and said feeder bed means for conveying said pressurized air flow to said feeder bed means whereby to fluidize said electrostatic powder contained therein.

15. Apparatus of claim 14 wherein said feeder bed means includes air exhaust means for conveying said pressurized air flow and any stray electrostatic powder carried by said air flow, out of said feeder bed means whereby to recover said stray electrostatic powder.

16. Apparatus of claim 1 wherein said pulsing means includes voltage means for providing said high voltage pulse, said apparatus also including coating initiator means positioned adjacent to said coating position for sensing when said substrate is in said coating position, and connected to said voltage means for transmitting a pulse-on signal thereto, said voltage means being responsive to said pulse-one signal for applying said high voltage pulse to said electrodes.

17. Apparatus of claim 16 wherein said pulsing means includes additional time delay means connected to said coating initiator means for receiving and delaying said pulse-on signal so as to generate a pulse-off signal a predetermined time interval, equal to said predetermined coating time, after the reception of said pulse-on signal, said voltage means being connected to said additional time delay means for receiving said pulse-off signal and responsive thereto for connecting said pair of electrodes to electrical ground.

18. Apparatus of claim 17 including shutter means carried by said applicator bed means and having a first condition for allowing coating of said substrate by said electrostatic powder and having a second condition for inhibiting coating of said substrate by said electrostatic powder, and shutter control means connected to said shutter means for moving the latter alternatively to said first and second conditions, said additional time delay means being connected to said shutter control means for transmitting said pulse-off signal thereto, said shutter control means being responsive thereto for moving said shutter means to said second condition.

19. Apparatus of claim 17 wherein said voltage means includes D.C. circuit means connected in series with said pair of electrodes to form a closed electrical loop for applying said high voltage to said pair of electrodes during said first state, and relay means in parallel with said pair of electrodes and actuable to an open circuit condition for forcing the application of said high voltage to said pair of electrodes during said first state and actuable to a closed circuit condition for short-circuiting said pair of electrodes to inhibit the application of said high voltage to said pair of electrodes during said second state.

20. Apparatus of claim 19 wherein said relay means is an electronic switch connected to said coating initiator means for receiving said pulse-on signal and responsive thereto for assuming said open circuit condition, and connected to said additional time delay means for receiving said pulse-off signal and responsive thereto for assuming said closed circuit condition.

21. Apparatus of claim 19 wherein said D.C. circuit means has two terminals each connnected to a respective one of said pair of electrodes, a given one of said terminals and said respective one of said pair of electrodes being connected to a common electrical ground.

22. Apparatus of claim 16 wherein said pulsing means includes additional time delay means connected to said coating initiator means for receiving and delaying said pulse-on signal so as to generate a pulse-off signal a predetermined time interval, equal to said predetermined coating time, after the reception of said pulse-on signal, said voltage means being connected to said additional time delay means for receiving said pulse-off signal and responsive thereto for applying to said electrodes a reverse high voltage pulse with polarity opposite to that of said high voltage pulse.

23. Apparatus of claim 22 wherein said voltage means includes first D.C. circuit means connected in series with said pair of electrodes for providing said high voltage pulse to said pair of electrodes during said first state, second D.C. circuit means connected in series with said pair of electrodes for providing said reverse high voltage pulse to said pair of electrodes during said second state, and switch means between said pair of electrodes, on the one hand, and said first and second D.C. circuit means, on the other hand, and having a first position for applying said high voltage pulse to said pair of electrodes during said first state and a second position for applying said reverse high voltage pulse to said pair of electrodes during said second state.

24. Apparatus of claim 23 wherein said switch means is connected to said coating initiator means for receiving said pulse-on signal and responsive thereto for assuming said first position, and connected to said additional time delay means for receiving said pulse-off signal in response thereto for assuming said second position.

25. Apparatus of claim 1 wherein said substrate to be coated is a can end unit.

26. An apparatus for electrostatically powdercoating a substrate occupying a coating position adjacent thereto, comprising in combination:

feeder bed means for receiving and for holding electrostatic powder to be used for coating;

fluidizing means adjacent to and operatively associated with said feeder bed means for fluidizing said electrostatic powder in said feeder bed means;

applicator bed means positioned in the vicinity of said coating position for holding said electrostatic powder during coating;

pump means extending between said feeder bed means and said applicator bed means for providing said fluidized powder to said applicator bed means;

additional fluidizing means adjacent to and operatively associated with said applicator bed means for fluidizing said electrostatic powder in said applicator bed means; and pulsing means connected to said applicator bed means for applying a high voltage discharge to said electrostatic powder for a predetermined coating time so as to effect ionization of said electrostatic powder whereby to cause the establishment of an electric field attracting said electrostatic powder particles to said substrate and including means to establish a reverse electric field whereby to attract excess powder particles away from said substrate .

27. Apparatus of claim 26 including level control means operatively associated with said applicator bed means and said feeder bed means for controlling the level of said electrostatic powder in said applicator bed means by draining off the excess powder over a predetermined level, said excess powder being returned to said feeder bed means.

28. Apparatus of claim 26 including mask means carried by said applicator bed means and positioned between said applicator bed means and said substrate for causing said substrate to be electrostatically coated in selected areas only.

29. Apparatus of claim 26 including shutter means carried by said applicator bed means and having a first condition for allowing coating of said substrate by said electrostatic powder and having a second condition for inhibiting coating of said substrate by said electrostatic powder.

30. Apparatus of claim 29 wherein said shutter means is a mechanical shutter positioned between said application bed means and said substrate.

31. Apparatus of claim 29 wherein said shutter means comprises air manifold means for creating an air curtain between said applicator bed means and said substrate so as to inhibit coating of said substrate whereby to establish said second condition.

32. Apparatus of claim 29 including shutter control means connected to said shutter means for moving the latter alternatively to said first and second conditions, and proximity sensing means positioned adjacent to said coating position for sensing when said substrate is in said coating position, and operatively associated with said shutter control means for causing said shutter control means to move said shutter means to said first condition.

33. Apparatus of claim 32 wherein said proximity sensing means provides an open-shutter signal when said substrate is in said coating position, and including time delay means connected to said proximity sensing means for receiving said open-shutter signal, and responsive thereto for transmitting to said pulsing means, after a predetermined period of delay, a pulse-on signal, said pulsing means being responsive thereto to apply said high voltage pulse to said electrostatic powder.

34. Apparatus of claim 26 wherein said fluidizing means includes a porous plate means positioned in horizontally level orientation for supporting and maintaining the powder in said applicator bed means.

35. Apparatus of claim 26 wherein said applicator bed means has small dimensions so as to minimize the required magnitude of said electric field whereby to minimize the magnitude of said voltage pulse applied by said pulsing means.

36. Apparatus of claim 26 wherein said fluidizing means includes an air chamber located adjacent to said feeder bed means and remote from said substrate, air compressor means connected to said air chamber for providing a pressurized air flow into said chamber, and porous plate means disposed between said air chamber and said feeder bed means for conveying said pressurized air flow to said feeder bed means whereby to fluidize said electrostatic powder contained therein.

37. Apparatus of claim 36 wherein said feeder bed means includes air exhaust means for conveying said pressurized air flow and any stray electrostatic powder carried by said air flow, out of said feeder bed means whereby to recover said stray electrostatic powder.

38. Apparatus of claim 26 wherein said additional fluidizing means includes an air chamber located adjacent to said applicator bed means and remote from said substrate, air compressor means connected to said air chamber for providing a pressurized air flow into said chamber, and porous plate means disposed between said air chamber and said applicator bed means for conveying said pressurized air flow to said applicator bed means whereby to fluidize said electrostatic powder contained therein.

* * * * *